United States Patent [19]

Stull

[11] Patent Number: 4,635,823

[45] Date of Patent: Jan. 13, 1987

[54] DISPENSING CLOSURE CONSTRUCTION

[76] Inventor: Gene Stull, 5 Oak St., Chester, N.J. 07930

[21] Appl. No.: 732,065

[22] Filed: May 9, 1985

[51] Int. Cl.[4] ..... B67D 1/16; B67D 3/00; B65D 5/72; B23P 11/02

[52] U.S. Cl. ..... 222/108; 222/543; 222/545; 222/571; 29/453

[58] Field of Search ..... 222/546, 109, 571, 545, 222/542, 543, 108, 111; 220/353, 306, DIG. 5; 215/235, 237; 29/453

[56] References Cited

U.S. PATENT DOCUMENTS

| | | | |
|---|---|---|---|
| 433,613 | 8/1890 | Barnes | 222/109 |
| 3,209,963 | 10/1965 | Krieps et al. | 222/542 |
| 3,307,752 | 3/1967 | Anderson | 222/546 |
| 4,377,247 | 3/1983 | Hazard et al. | 222/543 |
| 4,377,248 | 3/1983 | Stull | 222/543 X |

*Primary Examiner*—Bartuska F. J.
*Assistant Examiner*—Gregory L. Huson
*Attorney, Agent, or Firm*—H. Gibner Lehmann; K. Gibner Lehmann

[57] ABSTRACT

A dispensing closure construction of the type having a base part or body that is held captive on a container neck, and a sealing cap and integral hinge connected to the body. The body has an off-center discharge orifice and a high, domed top portion behind the orifice and extending above the level thereof so as to channel product from the top portion back toward the orifice after the container is used and returned to an upright position. A continuous sealing shoulder on the body engages the inner cylindrical surface of the sealing cap near its edge when the latter is swung to its closed position to minimize the possibility of water or other liquid from entering the area around the underside of the cap. A rib carried on the underside of the sealing cap is receivable in a recess in the domed top portion, and can engage opposed, facing shoulders so as to limit relative turning between the cap and body. The rib and recess are adjacent the location of the hinge. This construction has the desired effect of reducing the likelihood of damage to the hinge if torque, from automatic capping equipment, is applied to the cap; such damage might otherwise occur where the capping equipment is arranged to drive the cap itself as opposed to conventional arrangements where the drive torque is applied to the body. The offset dispensing orifice is sealed by a depending sealing peg on the cap. The off-center location of the peg and orifice also operate to limit relative turning between the cap and body, and provide added protection against inadvertent stretching or breakage of the hinge.

15 Claims, 6 Drawing Figures

DISPENSING CLOSURE CONSTRUCTION

BACKGROUND OF THE INVENTION

This invention relates generally to closure cap constructions of the type that are intended to be assembled onto the necks of existing containers, and which employ a base part that is captive on the container, and a sealing cap or overcap connected to the base part by means of an integral hinge structure.

Various closure devices of the type noted above have been proposed and produced in recent years. Typical arrangements are disclosed in U.S. Pat. Nos. 3,124,281; 3,877,598; and 4,377,248. All of the patented devices involve a base part that is either screwed onto a container neck, or otherwise secured thereto, as by a snap fit. An integral hinge structure was generally employed for holding captive the overcap and preventing it from inadvertently becoming misplaced, etc. during use of the dispenser. The length of the hinge was sufficient to allow the overcap to be readily swung between its closed or sealing position and its open or discharging position.

In automated assembly where automatic capping equipment is employed, the closure cap devices were held in suitable fixtures, and torque was applied to the base part in order to screw it onto the particular container neck. When this was done, there was virtually no stress or force applied to the overcap, and thus no tendency for there to occur breakage or stretching of the hinge. However, recently it has been necessary for certain applications, to employ existing capping equipment that was not capable of applying torque to the base part. In constructions such as those illustrated in the above patents, if the amount of torque was sufficiently great, the overcap slipped with respect to the base part, and caused either stretching or breakage of the hinge. The problem would be more serious with arrangements where the hinge was extremely short, as in the case of a "living" hinge, that is, one which was constituted for the most part as a membrane in the form of a fold along a line of weakness between two more rigid parts. Typical constructions are shown in U.S. Pat. Nos. 4,377,247; 4,220,248; 3,240,405; and 4,261,486.

It appears that the problem of potential breakage of a hinge in a cap construction is not addressed in any of the above patents.

Another area which caused concern was a tendency for product to build up around the area outside of a spout or discharge opening in a dispenser. When this occurred, the material usually dried out and hardened. Where the product being dispensed was a glue or adhesive, the hardened product eventually built up to an extent where it interfered with proper opening and closing of the cap. With other substances, such as foods, the hardened product had to be removed, and the cap cleaned periodically. The problem was especially troublesome where the discharge orifice took the form of an upstanding spout, that is, one which projected a substantial distance around an upper or top wall of a base cap. Several of the above patents show devices possessing this characteristic spout; the problems with dried product accumulating around the outside of the spout can be readily appreciated.

SUMMARY

The above disadvantages and drawbacks of prior closure cap constructions are largely obviated by the present invention which has for an object the provision of a novel and improved dispensing closure for dispensing liquid product from containers, which is simple in its structure and which is highly resistant to inadvertent damage from torque applied by automatic assembly or capping equipment.

A related object of the invention is to provide an improved dispensing closure as above set forth wherein the tendency for product to accumulate around the discharge orifice and dry or solidify is significantly reduced, as compared to many prior devices.

Still another object of the invention is to provide an improved dispensing closure of the kind indicated, which is easy for the manufacturer to assemble, and simple for the consumer to use.

Yet another object of the invention is to provide an improved dispensing closure as above characterized, which is both rugged and reliable, and wherein the integrity of the seal is maintained over the useful life of the dispenser.

The above objects are accomplished by a dispensing closure comprising a body adapted to be secured to the neck of a container, the body having an off-center discharge orifice and having a high, domed, segmental-shaped top portion disposed laterally of the orifice and including a transverse top wall, and a sealing cap adapted to fit over and to be mounted on the body. The body and cap are connected by an integral hinge. The cap has a sealing peg receivable in the discharge orifice of the body when the cap is in a mounted, sealing position thereon. The domed top portion of the body has a sloping barrier wall extending from the transverse top wall obliquely downward to the offcenter discharge orifice. The orifice has a flared dripless pouring lip which is disposed substantially tangential with respect to the barrier wall.

The above objects are further accomplished by a dispensing closure comprising a body intended to be secured onto the neck of a container, the body having an off-center discharge orifice and having a high, domed, segmental-shaped top portion including a transverse top wall, and a sealing cap. The cap is connected to the body by an integral hinge. The off-center discharge orifice has a pouring lip all portions of which are disposed substantially below the level of the transverse top wall, thereby minimizing the tendency for liquid to flow from the lip toward the transverse top wall when the closure is returned to an upright position.

The objects are further accomplished by a dispensing closure of the type noted above, wherein the domed top portion has a recess with opposed, facing shoulders adjacent the location of the hinge, and the sealing cap has a top wall and an annular side wall, and a stabilizer rib integral with and projecting from one of the immediately preceding walls. The rib is receivable in the recess when the sealing cap is in its closed position, and is engageable with either of the shoulders so as to limit relative turning between the sealing cap and cap body. There is thus minimized the possibility of breakage of the hinge resulting from torque applied solely to the sealing cap.

Other features and advantages will hereinafter appear.

In the drawings, illustrating a preferred embodiment of the invention:

Figure 6:
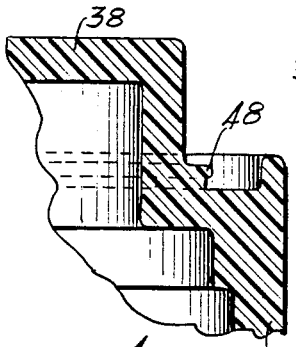
FIG. 6 is a fragmentary section taken on the line 6—6 of FIG. 3.
Figure 1:
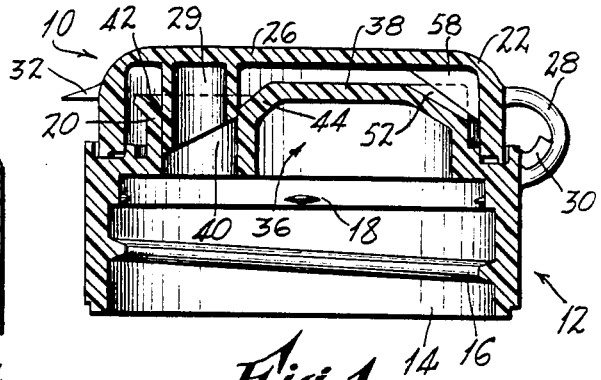
FIG. 1 is a vertical section of the improved dispensing closure of the present invention, showing the sealing cap in the closed position.
Figure 2:
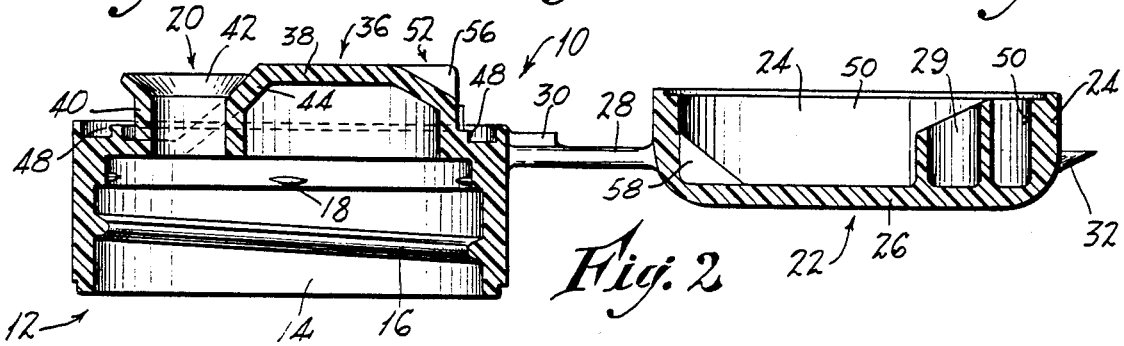
FIG. 2 is a vertical section of the dispensing closure of FIG. 1, except showing the sealing cap as having been swung to an open, product-discharging position.

Referring to the Figures there is illustrated a dispensing closure 10 for a container (not shown) of the type having a neck portion adapted to receive and hold captive the closure. The closure comprises a body 12 having an annular wall 14 and an internal thread 16 thereon, for securing the closure onto the container. A series of nibs or retainer lugs 18 on the underside of the body is provided, to retain a sealing liner (not shown) for engagement with the lip of the container. The body has a discharge opening or orifice designated 20. A sealing cap 22 having an annular side wall 24 and a transverse top wall 26 is connected to the body by means of a flexible hinge 28 such that the cap 22 can be swung from a first position closing off the orifice 20 of the body, as shown in FIG. 1, to a second position wherein the orifice of the body is exposed, as shown in FIG. 2. An integral sealing peg 29 is provided on the underside of the sealing cap 22. The hinge 28 may optionally have a rib 30 or other portion of increased thickness, to provide added stiffness. With such a construction, the sealing cap 22 will have a "memory", and tend to assume a more fully open position than would be the case were the reinforcement to be omitted. The sealing cap 22 has a finger-engageable lifting tab 32 to facilitate its removal; the integral depending sealing peg 29 is seen to be telescopically receivable in the discharge orifice 20 so as to seal off the same when the cap 22 is in the position of FIG. 1.

Figure 3:
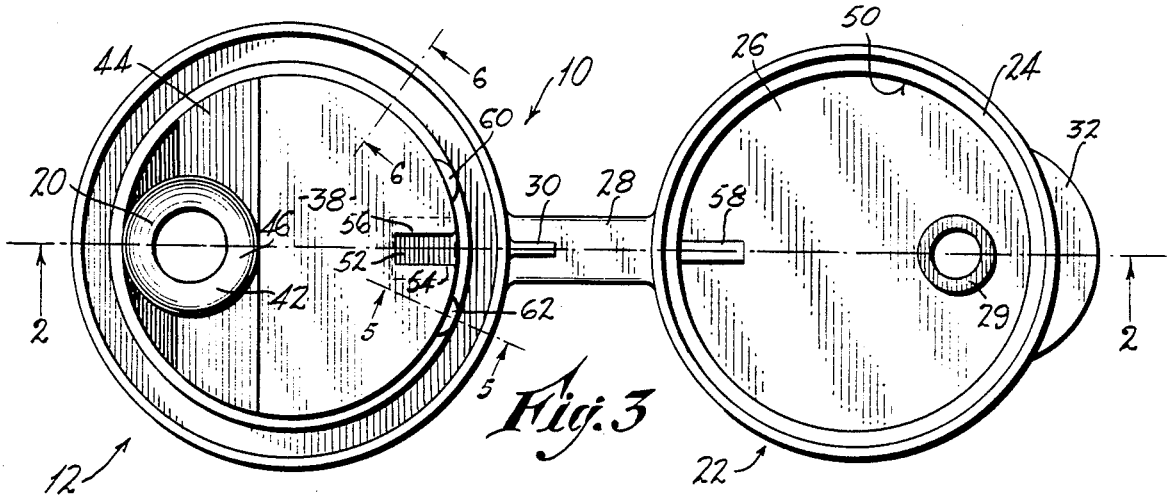
FIG. 3 is a top plan view of the dispensing closure of FIGS. 1 and 2, with the sealing cap in its open position.
Figure 4:
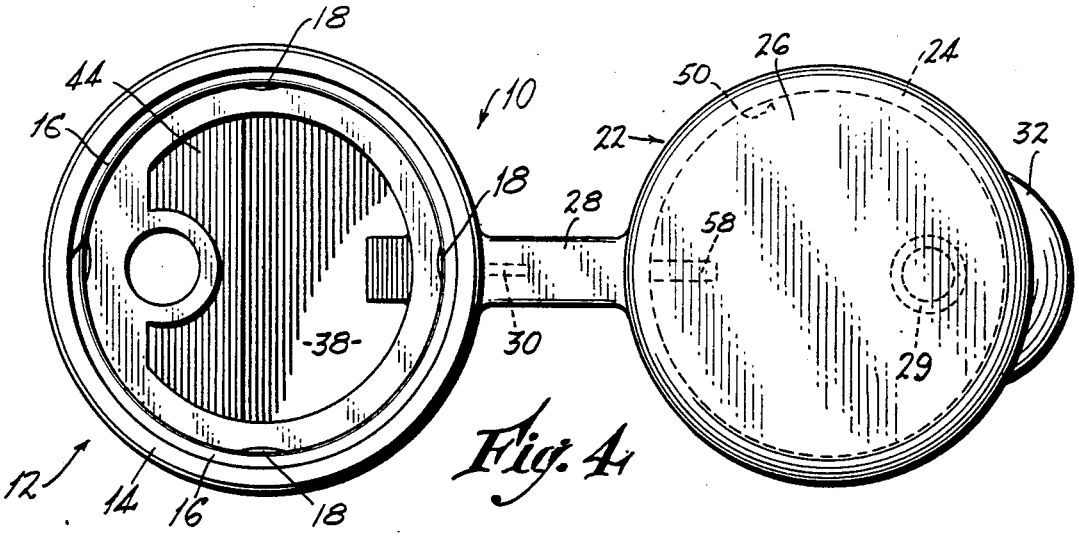
FIG. 4 is a bottom plan view of the dispensing closure of FIGS. 1-3, with the sealing cap in its open position.

In accordance with the present invention the discharge orifice 20 on the body 12 is off-center, and located behind the orifice is a high, domed, segmental-shaped top portion 36 including a transverse top wall or plateau 38. The top wall 38 is generally parallel to the top wall 26 of the cap 22 when the latter is closed. All portions of the plateau are substantially above the level of the discharge orifice 20. The orifice is preferably in the form of an upstanding spout 40 having a conical or flared edge 42, constituting a lip having a dripless characteristic. Between the domed top wall 38 and the spout 40 is a sloping barrier wall 44. This latter wall is generally planar, and has a tangential relationship with the inner surface of the dripless spout 40 along a line or at a location indicated in FIG. 3 by the numeral 46. In effect, the barrier wall 44 merges into the conical part 42 of the dripless spout 40, such that product which occupies the area about the edge 42 will flow, by gravity, back into the spout 40. Similarly, product inadvertently arriving at the sloping barrier wall 44 during use of the dispenser, will flow by gravity down the wall and back into the spout when the dispenser is set in its upright position, following such use. Thus there is minimized any tendency for product to arrive at the the plateau 38. (In use, the dispenser is tilted in such a manner that the product flows over the left portion of the spout 40 in FIG. 2, with little or no material flowing toward the barrier wall 44. The purpose of the barrier wall is to catch any residual material from the spout and prevent it from flowing toward the right in FIG. 2). The raised configuration of the plateau 38 thus minimizes accumulation of dispensed product and helps alleviate problems with dried product becoming encrusted thereon.

Further, by the invention there is provided a sealing shoulder in the form of a radially outwardly facing barrier bead 48 on the upper surface of the cap body 12, the bead 48 being in the form of a continuous loop-shaped sealing shoulder extending around both the orifice 20 and the domed top portion 36. The bead is intended to be engaged by the inner cylindrical surface 50 of the sealing cap near its open end when the latter is swung to the position of FIG. 1. Such an arrangement limits access to the top of the cap body 12 and underside of the sealing cap 22 when the dispensing closure is in its sealed condition. With certain food products, after the containers are filled at the manufacturing plant the entire dispenser generally is passed through a warm water bath. Without the provision of the barrier bead 48, some of this water might leak into the area between the top surface of the cap body 12 and the underside of the sealing cap 22. Accordingly, in combination with other features of the closure construction, this feature of the barrier bead is considered to be an important aspect of the present invention.

Figure 5:
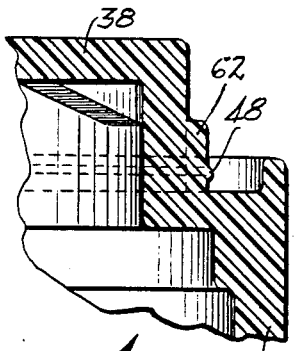
FIG. 5 is a fragmentary section taken on the line 5—5 of FIG. 3.

Also in accordance with the invention, means are provided in the domed top portion 36 and on the underside of the sealing cap 22, for limiting relative turning movement between the sealing cap 22 and body 12 when the cap is assembled. In accomplishing this objective, there is provided in the domed top portion 36 a recess 52 having opposed, facing shoulders 54, 56. The recess is intended to receive a stabilizing lug or locking rib 58 disposed on the underside of the sealing cap 22 when the latter is closed. The stabilizing lug is particularly shown in FIGS. 2, 3 and 5, and in the present instance is molded integral with both the top wall 26 and the annular side wall 24 of the sealing cap 22. The rib has generally the configuration of a gusset, and functions not only to limit turning of the sealing cap 22, but also provides a desired stiffening thereto. The rib 58 is disposed adjacent the location of the hinge 28, as shown. The thickness of the rib is somewhat less than the distance between the shoulders 54, 56, for clearance during closing of the cap. The hinge 28 forms a resilient loop of relatively long length when the sealing cap is mounted on the body, such that even if a slight turning of the sealing cap with respect to the body occurs, the opposite ends of the hinge loop can shift adequately to avoid any damage to the hinge.

As a result of the provision of the cooperable rib 58 and recess structure 52 described above, together with the off-center orifice 20 and sealing peg 29 that is telescopically received therein, any torque applied to the sealing cap 22 will be transmitted, for the most part, to the cap body 12, and lateral stresses which might otherwise be applied to the hinge 28 are completely eliminated.

The present arrangement has the advantage that where automatic capping equipment is employed, and where the dimensions of the fixtures of the equipment are insufficient to enable them to engage the cap body 12 directly, they can accept the sealing cap 22 instead, and the torque applied thereto will for the most part be directly transmitted to the cap body. Since it is usually the manufacturer's intent to discourage unscrewing of the cap body 12 from the container neck, the magnitude of the applied torque is often substantial. In the past, with the devices of the prior art, problems have occurred with either stretching or breakage of the hinge 28 where torque was applied to a sealing cap such as that indicated 22, and with no provision made for transmitting the torque to the cap body 12.

By the invention, the domed top portion 36 of the body 12 has two small lugs 60, 62 on opposite sides of the hinge, these constituting guide surfaces which are intended to engage the inner cylindrical surface of the annular wall 24 of the sealing cap 22 as the latter is moved from the dispensing position toward its mounted, sealing position. One of the guide lugs is illustrated particularly in FIG. 5. The two lugs are disposed symmetrically on opposite sides of a diametric line of the cap body, as shown best in FIG. 3.

From the above it can be seen that I have provided a novel and improved dispensing closure for containers, the device being simple in its structure and convenient and reliable in use. The entire closure can be molded as a single integral piece, thereby minimizing manufacturing and assembly costs. Problems with inadvertent damage to the closure resulting from automatic capping equipment are virtually eliminated by the provision of the rib 58 and recess 52, and the judiciously-chosen location of the orifice 20 and sealing peg 27.

By the provision of the dripless spout 40 and the high, domed top portion 36 of the cap body, there is greatly minimized any tendency for product to accumulate outside of the discharge orifice. A much neater appearance is thus realizeable, especially after a period of extended use of the dispenser. This consideration is deemed to be of great importance where the device is employed with food products, and where the build up of dried food would constitute an unsightly appearance for the consumer, as well as posing a health hazard from possible contamination or other unsanitary conditions of the type normally associated with food dispensers.

The above device is thus seen to represent a distinct advance and improvement in the field of dispensing closures.

Each and every one of the appended claims defines an aspect of the invention which is separate and distinct from all others, and accordingly each claim is to be treated in this manner when examined in the light of the prior art devices in any determination of novelty or validity.

Variations and modifications are possible without departing from the spirit of the invention.

What is claimed is:

1. A dispensing closure for dispensing liquid product from containers, comprising in combination:

(a) a body having means for securing it to the neck of the container, (b) said body having an off-center discharge orifice and having a high, domed, segmental-shaped top portion disposed laterally of the orifice and including a transverse top wall, (c) a sealing cap adapted to fit over and to be mounted on said body, and (d) a hinge connecting and integral with said body and sealing cap, (e) said sealing cap having a sealing peg adapted to be received in the discharge orifice of the body when the sealing cap is in a mounted sealing position on the body, (f) said domed top portion of the body having a sloping barrier wall extending from said transverse top wall obliquely downward to said off-center discharge orifice, (g) said off-center discharge orifice having a pouring lip all portions of which are disposed substantially below the level of said transverse top wall, thereby minimizing the tendency for liquid to flow from the lip toward the transverse top wall when the closure is tilted from an upright position.

2. A dispensing closure for dispensing liquid product from containers, comprising in combination:

(a) a body having means for securing it to the neck of the container, (b) said body having an off-center discharge orifice and having a high, domed, segmental-shaped top portion disposed laterally and entirely at one side of the orifice and including a transverse top wall, (c) a sealing cap adapted to fit over and to be mounted on said body, and (d) a hinge connecting and integral with said body and sealing cap, (e) said sealing cap having a sealing peg adapted to be received in the discharge orifice of the body when the cap is in a mounted sealing position on the latter, (f) said domed top portion of the body having a sloping barrier wall disposed in a different plane from said top wall and extending from said transverse top wall obliquely downward into said off-center discharge orifice, (g) said off-center discharge orifice having a flared dripless pouring lip a portion of which is common to said barrier wall.

3. A dispensing closure for dispensing liquid product from containers, comprising in combination:

(a) a body having means for securing it to the neck of the container, (b) said body having an off-center discharge orifice and having a high, domed, segmental-shaped top portion disposed laterally and entirely at one side of the orifice and including a transverse top wall, (c) said body further having a continuous loop-shaped sealing shoulder extending around both said off-center orifice and said domed top portion, (d) a sealing cap having an outer circular wall adapted to fit over and to be mounted on said body, and (e) a hinge connecting and integral with said body and sealing cap, (f) said sealing cap having a sealing peg adapted to be received in the discharge orifice of the body when the cap is in a mounted sealing position on the latter, (g) said sealing cap further having an interior wall sealing surface on said outer circular wall and engageable with the sealing shoulder of the body to prevent external liquid from leaking into the interior of the closure when the sealing cap is in its mounted sealing position, (h) said sealing shoulder comprising a radially outwardly extending bead on said body, (i) said sealing cap having an annular wall with a smooth cylindrical inner sealing surface thereon, said sealing surface being disposed closely adjacent the open end of the sealing cap and being sealingly engaged by said outwardly extending bead on the body when the cap is in its mounted sealing position, (j) said domed top portion of the body having a sloping barrier wall disposed in a different plane from said top wall and extending from said transverse top wall obliquely downward into said off-center discharge orifice.

4. A dispensing closure for dispensing liquid product from containers, comprising in combination:

(a) a body having means for securing it to the neck of the container, (b) said body having an off-center discharge orifice and having a high, domed, segmental-shaped top portion disposed laterally of the orifice and including a transverse top wall, (c) a sealing cap adapted to fit over and to be mounted on said body, and (d) a hinge connecting and integral with said body and sealing cap, (e) said sealing cap having a sealing peg adapted to be received in the discharge orifice of the body when the cap is in a mounted sealing position on the latter, (f) said domed top portion of the body having a sloping barrier wall extending from said transverse top wall obliquely downward to said off-center discharge orifice, (g) said off-center discharge orifice having a flared dripless pouring lip which is disposed substantially tangential with respect to said barrier wall, (h) said top wall being disposed above the said dripless pouring lip.

5. A dispensing closure for dispensing liquid product from containers, comprising in combination:

(a) a body having means for securing it to the neck of the container, (b) said body having an off-center discharge orifice and having a high, domed, segmental-shaped top portion disposed laterally and entirely at one side of the orifice and including a transverse top wall, (c) said body further having a continuous loop-shaped sealing shoulder extending around both said off-center orifice and said domed top portion, (d) a sealing cap having an outer circular wall adapted to fit over and to be mounted on said body, and (e) a hinge connecting and integral with said body and sealing cap, (f) said sealing cap having a sealing peg adapted to be received in the discharge orifice of the body when the cap is in a mounted sealing position on the latter, (g) said sealing cap further having an interior wall sealing surface on said outer circular wall and engageable with the sealing shoulder of the body to prevent external liquid from leaking into the interior of the sealing cap when the latter is in its mounted sealing position, (h) said domed top portion of the body having a guide surface disposed adjacent said hinge and separate from said sealing shoulder and engageable with means on the said interior wall surface of the cap adjacent said hinge to guide said outer circular wall onto the loop-shaped sealing shoulder of the body as the cap is moved from the dispensing position toward its mounted sealing position.

6. A dispensing closure as set forth in claim 1, wherein:

(a) the domed top portion of the body has an additional guide surface engageable with the interior wall of the cap and spaced from the first-mentioned guide surface, to provide additional guidance for the interior wall.

7. A dispensing closure as set forth in claim 1, wherein:

(a) said guide surface is provided by a land on the outside of the said domed top portion.

8. A dispensing closure for dispensing liquid product from containers, comprising in combination:

(a) a body having means for securing it to the neck of the container, (b) said body having an off-center discharge orifice and having a high, domed, segmental-shaped top portion disposed laterally of the orifice and including a transverse top wall, (c) a sealing cap adapted to fit over and to be mounted on said body, and (d) a hinge connecting and integral with said body and sealing cap, (e) said domed top portion having a recess with opposed, facing shoulders adjacent the location of the hinge, (f) said sealing cap having a top wall and an annular side wall, and having a stabilizer rib integral with and projecting from one of said sealing cap walls at the location of said hinge, (g) said rib being received in the recess when the sealing cap is mounted on the body and engageable with one of said shoulders so as to limit relative turning between the sealing cap and the cap body and thereby minimize the possibility of breakage of the hinge resulting from torque applied to the sealing cap.

9. The invention as set forth in claim 8, wherein:

(a) said rib is integral with the top wall of the sealing cap.

10. The invention as set forth in claim 8, wherein:

(a) the rib is integral with the annular side wall of the sealing cap.

11. The invention as set forth in claim 8, wherein:

(a) said hinge forms a resilient loop when the sealing cap is mounted on the body, (b) the opposite ends of said loop capable of limited relative movement in opposite circumferential directions, without damage occurring to the hinge.

12. The invention as set forth in claim 8, and further including:

(a) a depending sealing peg carried on the underside of the sealing cap and integral therewith, (b) said sealing peg being receivable in the discharge orifice when the sealing cap is mounted on the body, (c) said sealing peg and orifice both being off-center, thereby to further minimize the possibility of breakage of the hinge resulting from torque applied to the sealing cap.

13. The invention as set forth in claim 12, wherein:

(a) the discharge orifice is substantially diametrically opposite the location of the hinge.

14. The invention as set forth in claim 8, wherein:

(a) the rib is integral with both the top wall and the annular side wall of the sealing cap.

15. The invention as set forth in claim 14, wherein:

(a) the rib has the configuration of a gusset.

* * * * *